US006270360B1

(12) United States Patent
Yanase

(10) Patent No.: US 6,270,360 B1
(45) Date of Patent: Aug. 7, 2001

(54) ELECTRIC JUNCTION BOX WITH A RELAY

(75) Inventor: Takeshi Yanase, Shizouka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/506,499

(22) Filed: Feb. 18, 2000

(30) Foreign Application Priority Data

Feb. 26, 1999 (JP) ..... 11-051217

(51) Int. Cl.[7] ..... H01R 9/09
(52) U.S. Cl. ..... 439/76.2
(58) Field of Search ..... 439/76.2, 949; 174/52.1

(56) References Cited

U.S. PATENT DOCUMENTS 5,285,011 * 2/1994 Shimochi ..... 174/52.1
5,928,004 * 7/1999 Sumida et al. ..... 439/76.2
6,051,782 * 4/2000 Wagner ..... 174/52.1
6,084,488 * 7/2000 Macbeth et al. ..... 335/132

FOREIGN PATENT DOCUMENTS

P2-74114 3/1990 (JP) .

* cited by examiner

*Primary Examiner*—Neil Abrams
*Assistant Examiner*—Phuong KT Dinh
(74) *Attorney, Agent, or Firm*—Finnegan, Henderson, Farabow, Garrett & Dunner, L.L.P.

(57) ABSTRACT

An electric junction box of this invention comprises a junction box main body, a relay disposed within the junction box main body, having a relay coil and a pair of bus bars arranged within the junction box main body. The pair of the bus bars have end portions opposing each other. A coil accommodating portion for accommodating the relay coil and a contact point portion are formed at an end of one bus bar of the pair of the bus bars, while other contact point portion corresponding to the one contact point portion is formed at the other end of the bus bar of the pair of the bus bars.

9 Claims, 5 Drawing Sheets

ELECTRIC JUNCTION BOX WITH A RELAY

BACKGROUND OF THE INVENTION

The present invention relates to an electric junction box and more particularly to an electric junction box in which a relay is incorporated integrally in a junction box main body thereof.

Japanese Patent Application Laid-Open Publication No. 2-74114 has disclosed an electric junction box in which a relay is incorporated in a junction box main body thereof.

SUMMARY OF THE INVENTION

The inventor of the present invention considered an electric junction box in which a relay is incorporated in a junction box main body thereof as shown in FIGS. 3 to 5.

An electric junction box 1 shown in FIGS. 3 and 4 has a junction box main body 2 made of synthetic resin. A connector portion 2*a* to which a relay 3 is to be fit is formed integrally so as to protrude, at a predetermined position of the junction box main body 2.

As shown in FIG. 4, the relay 3 comprises a substrate 3*a* made of synthetic resin and a box-shaped outside cover 3*b* made of synthetic resin for covering this substrate 3*a*. A proximal end of a male tab portion 4*a* of a U-letter shaped connection terminal 4 and a proximal end of a male tab portion 5*a* of a sheet-like connection terminal 5 are buried in the substrate 3*a*.

A L-letter shaped coil accommodating portion 4*b* and a contact point portion 4*c* which acts as a movable contact point are formed at the connection terminal 4 by bending.

Further, a contact point portion 5*c* which serves as a fixed contact point is formed at a connection terminal 5 apart inward from the contact point portion 4*c* of the connection terminal 4 by a predetermined clearance.

A relay coil 6 is incorporated between the coil accommodating portion 4*b* of the connection terminal 4 and the contact point portion 5*c* of the connection terminal 5. Both ends of the relay coil 6 are connected to a pair of connection terminals 7, 7 buried in front and rear portions of the substrate 3*a*.

If, with such a structure, current is supplied to the relay coil 6 through the pair of the connection terminals 7, 7, the relay coil 6 turns to an electric magnet, so that the contact point portion 4*c* located outside the connection terminal 4 is abstracted to the contact point portion 5*c* located inward of the connection terminal 5 and they contact each other. As a result, both the contact point portions 4*c*, 5*c* are closed, so that a predetermined circuit of the electric junction box 1 is turned on through the relay 3 (electric power is supplied).

However, because the electric junction box 1 having such a structure is so constructed that the relay 3 is connected to the connector portion 2*a* of the junction box main body 2, a component necessary for electric connection such as the connection terminals 4, 5, 7 and outside cover 3*b* of the relay 3, connector portion 2*a* of the junction box main body 2 and the like are necessary.

Thus, the quantity of the parts increases. Such an increase of the quantity of the parts leads to increases of production cost and quantity of electrically connected portions, thereby sometimes leading to an obstacle against further improvement of reliability.

On the other hand, a junction box main body 2' of an electric junction box 1' shown in FIG. 5 comprises a main cover 2A made of synthetic resin, overlaid body 2B formed by overlaying a plurality of bus bar circuit boards and an under cover 2C.

Then, a relay 3' mounted on a relay mounting portion 2*a*' of the main cover 2A is connected to the male tab portion 9*a* of the bus bar 9 protruded from the overlaid body 2B through a relay terminal 8.

However, in the conventional electric junction box 1' having such a structure, a connection terminal (not shown) of the relay 3' mounted on the main cover 2A is connected to the male tab portion 9*a* of the bus bar 9 on the overlaid body 2 through the relay terminal 8.

Therefore, because this structure also needs the relay terminal 8, the quantity of the parts increases thereby leading to increases of production cost and the like.

Accordingly, the present invention has been accomplished with the above consideration and therefore, an object of the invention is to provide an electric junction box in which a relay is incorporated in a junction box main body thereof, so that the quantity of the parts and electric connections are reduced, thereby achieving reductions of production cost and size and further improvement of reliability.

To achieve the above object, an electric junction box of the present invention comprises a junction box main body, a relay coil disposed in the junction box main body, a pair of bus bars arranged in the junction box main body, and a pair of contact point portions. The pair of the bus bars have end portions opposing each other. A coil accommodating portion for accommodating the relay coil and one contact point portion are formed at the end portion of one bus bar of the pair of the bus bars, while other contact point portion opposed to one contact portion is formed at the end portion of the other bus bar of the pair of the bus bars.

Due to the above structure, as the relay coil, the pair of bus bars and the pair of contact point portions can forms a relay, such a relay can be formed integrally within the junction box main body, and the quantity of the parts and electric connections can be reduced, thereby achieving reductions of production cost and size, and improvement of reliability.

Here, it is preferred that the coil accommodating portion and the one contact point portion are formed integrally using an end portion of the one bus bar in viewpoint of simple and secure structure. Further, it is preferable that the coil accommodating portion and the one contact point portion are formed by bending the end portion of the one bus bar in an inverted U-letter shape in viewpoint of the simple and secure structure.

On the other hand, preferably, a central portion of the other bus bar is formed in a L-letter shape, thereby enhancing the degree of freedom in layout of the components of the electric junction box.

Further, preferably, a connection portion to which a terminal of an electric part is to be connected is formed at the other end portion of the other bus bar, so that other part such as a relay terminal becomes unnecessary when the electric part is connected to the relay. As a result, the quantity of the parts is reduced thereby achieving further reduction of production cost. Further, preferably, the connection portion is formed by processing the terminal portion of the other bus bar in an inverted Ω-letter shape so that a simpler and more secure connection is achieved. For example, a fuse is used as the electric part.

Preferably, a pair of bus bars for carrying current are connected to the relay coil so that current is supplied securely under a simple structure.

DETAILED DESCRIPTION OF THE PREFERRED EMBODIMENT

Hereinafter, the preferred embodiment of the present invention will be described in detail with reference to the accompanying drawings.

Figure 1:
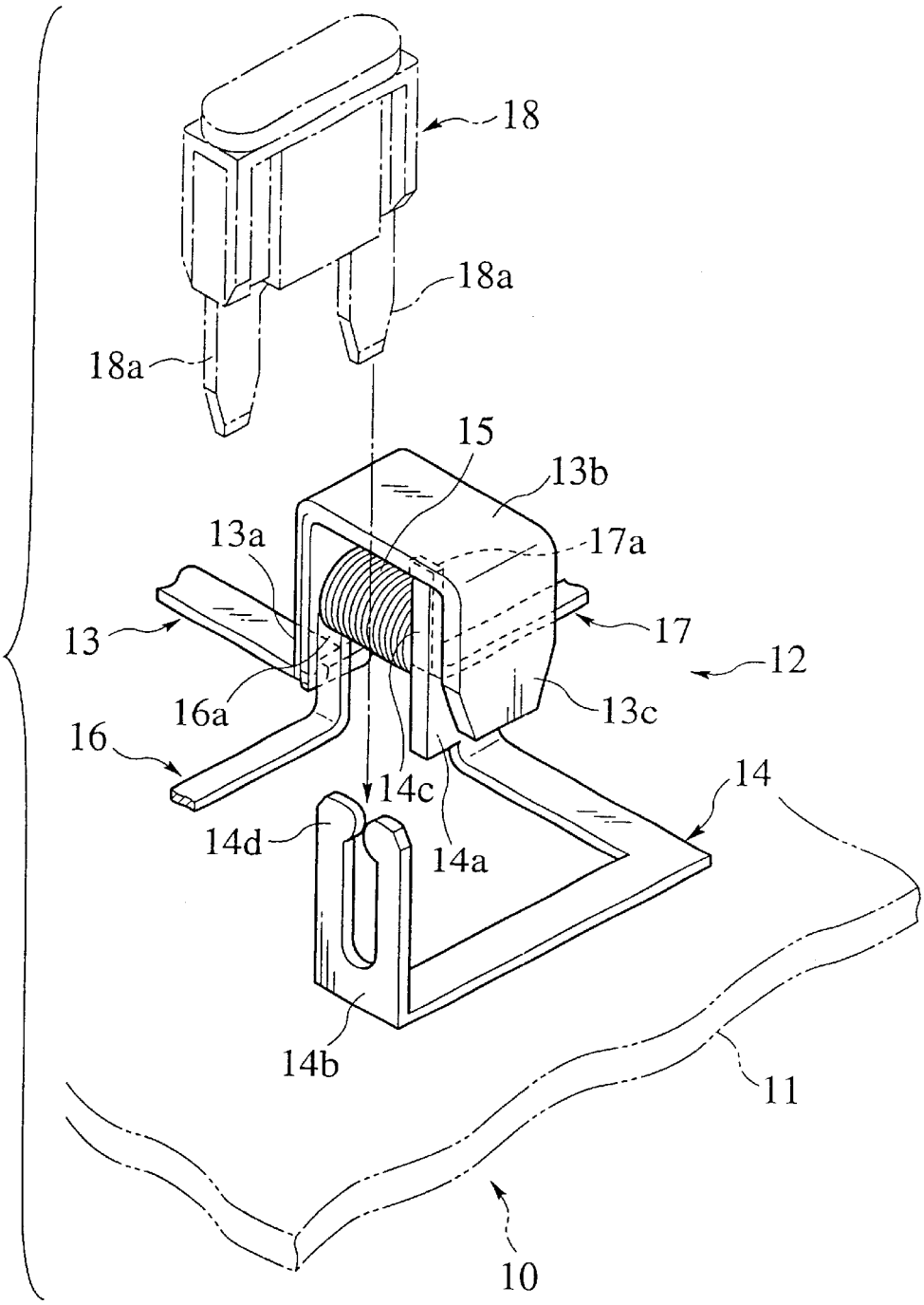
FIG. 1 is an expanded perspective view of major portions of an electric junction box according to a first embodiment of the present invention.
Figure 2:
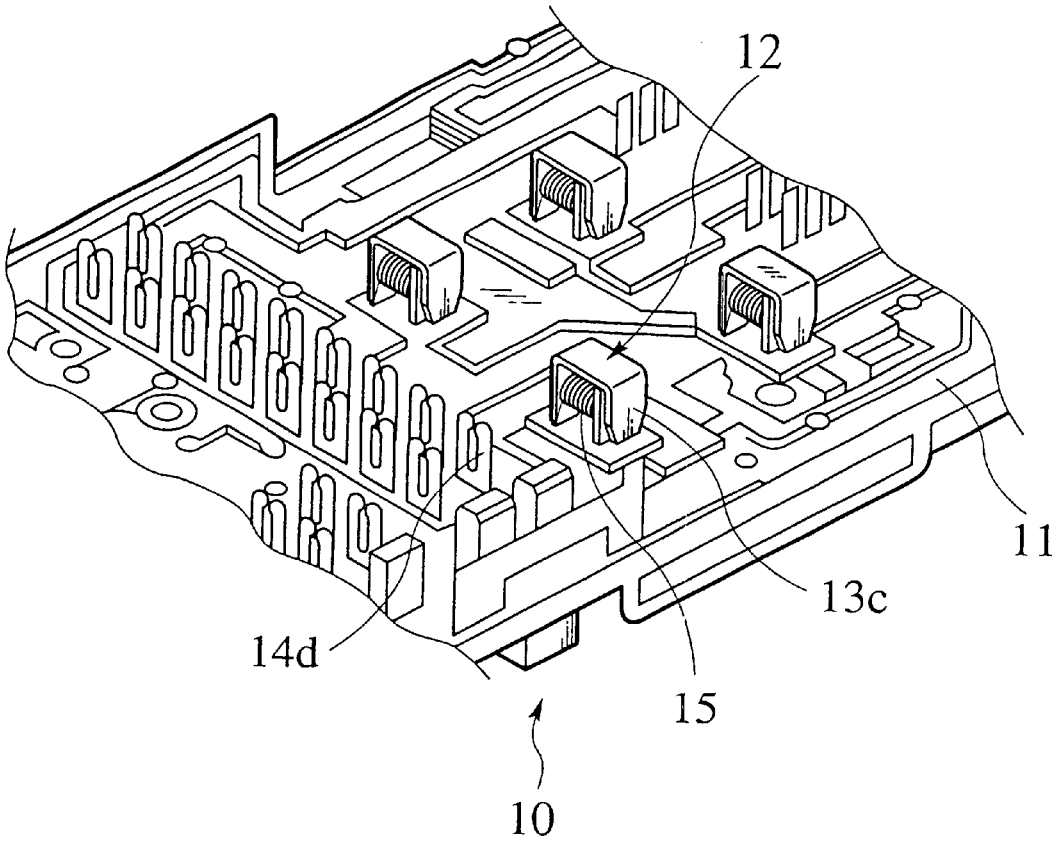
FIG. 2 is a partial perspective view showing a state in which a plurality of relays are incorporated in the junction box main body of the electric junction box according to the embodiment.
Figure 3:
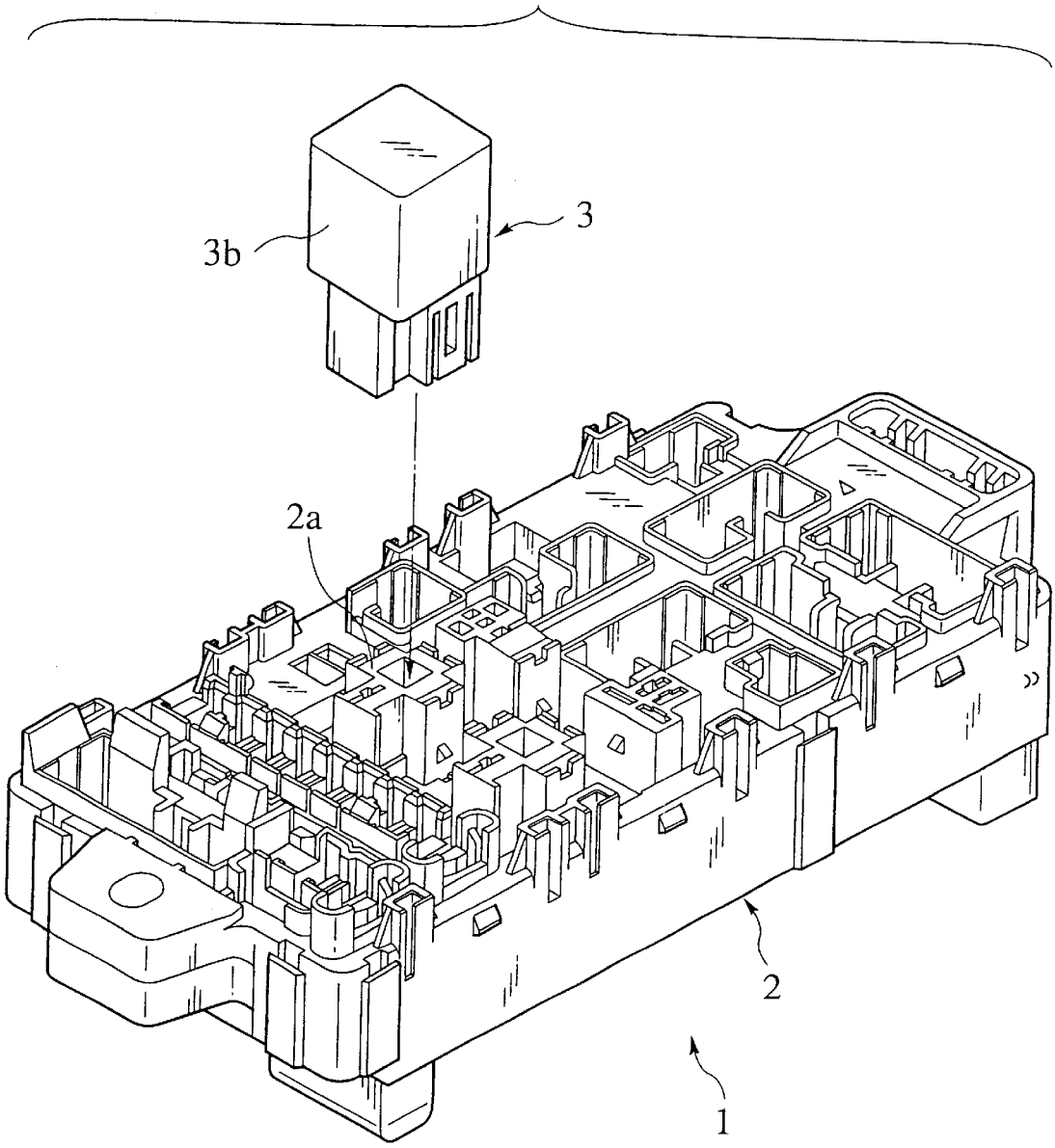
FIG.3 PRIOR ART
FIG. 3 is a perspective view of an electric junction box which the inventor of the present invention studied.
Figure 4:
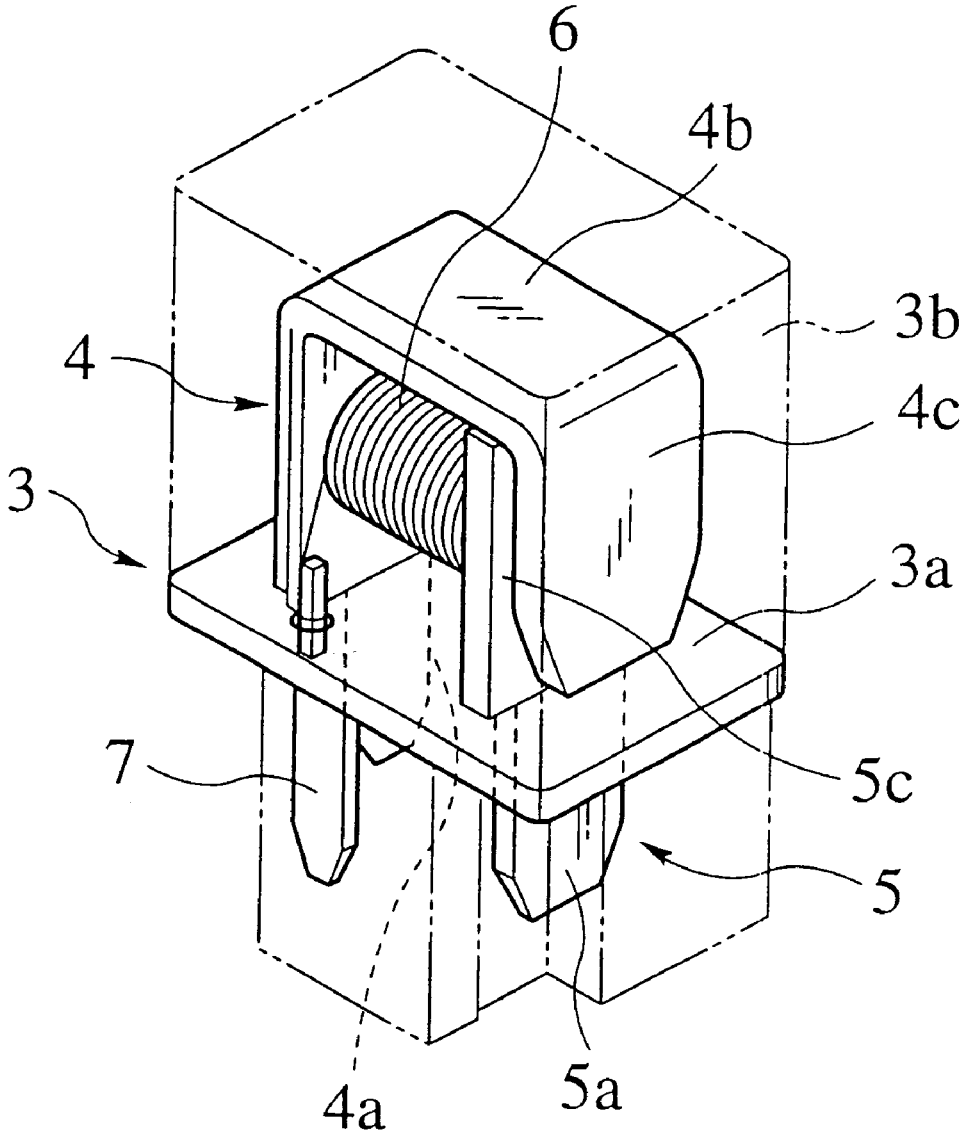
FIG.4 PRIOR ART
FIG. 4 is a perspective view showing an internal structure of a relay for use in the same electric junction box.
Figure 5:
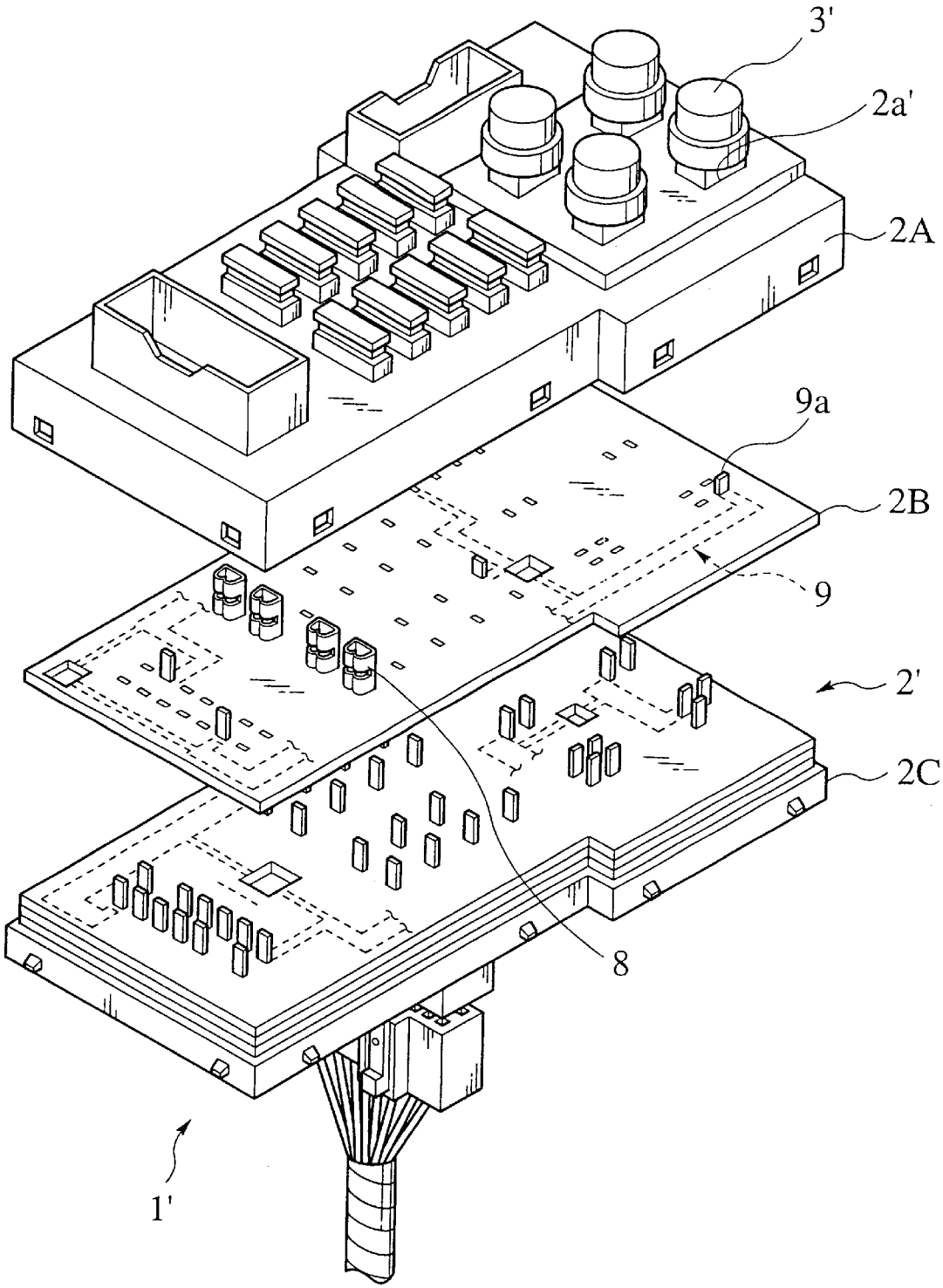
FIG.5 PRIOR ART
FIG. 5 is a perspective view of other electric junction box which the inventor of the present invention studied.

As shown in FIGS. 1, 2, the electric junction box 10 of this embodiment contains a junction box main body 11 made of synthetic resin.

This junction box main body 11 contains a relay 12. This relay 12 comprises a pair of bus bars 13, 14 arranged within the junction box main body 11, a relay coil 15 interposed between the pair of the bus bars 13 and 14 and a pair of bus bars 16, 17 for carrying current to this relay coil 15.

Particularly as shown in FIG. 1, the pair of the bus bars 13, 14 are extended upward so that respective end portions 13*a*, 14*a* thereof oppose each other in a vertical direction.

On the other hand, a coil accommodating portion 13*b* and a contact point portion 13*c* which acts as a movable contact point are formed on the side of the terminal portion 13*a* of the bus bar 13 by bending the bus bar 13 in a substantially inverted U-letter shape.

On the other hand, a contact point portion 14*c* which acts as a fixed contact point is formed integrally with a terminal portion 14*a* of the other bus bar 14 such that it is located inward of the contact point portion 13*c* of the bus bar 13 apart therefrom by a predetermined gap by bending the bus bar 14 upward in a vertical direction.

A relay coil 15 formed by winding electric wire in a coil shape is accommodated between the coil accommodating portion 13*b* of the bus bar 13 and the contact point portion 14*c* of the other bus bar 14 and incorporated in the electric junction box 10.

A central portion of the other bus bar 14 is formed in a L-letter shape flat in a plan view. A substantially inverted Ω-letter shaped connection portion 14*d* to which a male terminal (terminal) 18*a* of a fuse (electric part) 18 is to be connected is formed integrally at the other end 14*b* by bending the other bus bar 14 upward in a vertical direction.

Both ends of the relay coil 15 are connected to vertically erected portions 16*a*, 17*a* at respective end portions of the bus bars 16, 17 for supplying electric power disposed within the junction box main body 11.

If, with the above mentioned structure, electric power is supplied to the relay coil 15 or current flows to the relay coil 15 through the pair of the bus bars 16, 17, the relay coil 15 turns to a strong electric magnet so that the contact point portion 13*c* of the bus bar 13 located outside is attracted to the contact point portion 14*c* of the other bus bar 14 located inside. As a result, both the contact point portions 13*c*, 14*c* come into contact with each other so as to close the relay 12.

Because in the electric junction box 10 having such a structure, the relay 12 is incorporated in the junction box main body 11 made of synthetic resin, a relay terminal and a connection terminal become unnecessary, so that the quantity of the parts and the quantity of the electric connections can be effectively reduced as a consequence.

As a result, reduction of production cost of the electric junction box 10, reduction of size and thickness thereof and improvement of reliability are achieved.

Further, because the substantially inverted Ω-letter shaped connection portion 14*d* is formed at the other end 14*b* of the bus bar 14, which is a part of the relay 12, integrally by bending the bus bar 14, any relay terminal, connection terminal and the like become unnecessary if other electric part such as a fuse 18 is connected to the relay 12, so that the quantity of the parts is reduced. As a result, reduction of production cost of the electric junction box 10 is further achieved.

Further, if such a relay 12 is used, a large current can be interrupted with a switch having a small capacity. For example, in case where a head lamp is lit with the relay 12, fuse 18 and the like contained in a head light circuit, when the lighting switch in an operator's seat is turned on, current flows to the relay coil 15 so that both the contact point portions 13*c*, 14*c* of the pair of the bus bars 13, 14 are closed, thereby the head lamp being lit. In this case, only current passing the relay coil 15 flows through the lighting switch and therefore, the purpose can be satisfied by a small amount of current.

Although the present invention has been described about an always-open contact point (make contact point) in which a pair of contact point portions are open when no current is supplied to the relay coil while the pair of the contact point portions are closed when current is supplied, it is needless to say that an always-close contact point (break contact point), in which the pair of the contact point portions are closed when no current is supplied to the relay coil while it is open when current is supplied thereto may be used.

Further, the electric part for use here is not restricted to a fuse, however it is also needless to say that other electric part may be used appropriately.

Further, the connection portion at the other end of the bus bar to which a terminal of an electric part is to be connected is not restricted to a slot-like, substantially inverted Ω-letter shaped connection portion, and, for example, a box-shaped female connection portion may be used.

What is claimed is:

1. An electric junction box comprising:

a junction box main body;

a relay coil disposed in the junction box main body;

a pair of bus bars arranged in the junction box main body, one of the pair of bus bars having a first end portion and the other of the pair of bus bars having a second end portion opposed to the first end portion; and a pair of contact point portions, wherein at the first end portion, a coil accommodating portion accommodating the relay coil and one of the pair of contact point portions are formed, while other of the pair of contact point portions is formed at the second end portion.

2. An electric junction box according to claim 1, wherein the coil accommodating portion and one of the pair of contact point portions are formed integrally using the first end portion.

3. An electric junction box according to claim 2, wherein the coil accommodating portion and one of the pair of contact point portions are formed by bending the first end portion in an inverted U-letter shape.

4. An electric junction box according to claim 1, wherein a central portion of the other of the pair of bus bars is formed in a L-letter shape.

5. An electric junction box comprising:

a junction box main body;

a relay coil disposed in the junction box main body;

a pair of bus bars arranged in the junction box main body, one of the pair of bus bars having a first end portion and the other of the pair of bus bars having a second end portion opposed to the first end portion; and a pair of contact point portions, wherein at the first end portion, a coil accommodating portion accommodating the relay coil and one of the pair of contact point portions are formed, while other of the pair of contact point portions is formed at the second end portion, the coil accommodating portion and one of the pair of contact point portions are formed integrally using the first end portion, and wherein a connection portion to which a terminal of an electric part is to be connected is formed at the other end portion with respect to the second end portion of the other of the pair of bus bars.

6. An electric junction box according to claim 5, wherein the connection portion is formed by processing the other end portion with respect to the second end portion in an inverted Ω-letter shape.

7. An electric junction box according to claim 5, wherein the electric part is a fuse.

8. An electric junction box according to claim 1, wherein a pair of bus bars carrying current is connected to the relay coil.

9. An electric junction box according to claim 1, wherein the relay coil, the pair of bus bars and the pair of contact point portions forms a relay.

* * * * *

UNITED STATES PATENT AND TRADEMARK OFFICE

CERTIFICATE OF CORRECTION

PATENT NO. : 6,270,360 B1
DATED : August 7, 2001
INVENTOR(S) : Yanase

It is certified that error appears in the above-identified patent and that said Letters Patent is hereby corrected as shown below:

Title page,
Item [75], in the Inventor "Shizouka-ken" should read -- Shizuoka-ken --.

Signed and Sealed this

Seventh Day of May, 2002

*Attest:*

*Attesting Officer*

JAMES E. ROGAN
*Director of the United States Patent and Trademark Office*